United States Patent [19]

Carpenter, Jr.

[11] Patent Number: 4,566,230

[45] Date of Patent: Jan. 28, 1986

[54] IMPACT BLASTING SYSTEM FOR ETCHING METAL SURFACES

[75] Inventor: James H. Carpenter, Jr., Hagerstown, Md.

[73] Assignee: Kennecott Corporation, Cleveland, Ohio

[21] Appl. No.: 621,483

[22] Filed: Jun. 18, 1984

Related U.S. Application Data

[63] Continuation of Ser. No. 354,916, Mar. 4, 1982, abandoned.

[51] Int. Cl.[4] ..... B24C 3/14

[52] U.S. Cl. ..... 51/420; 51/439

[58] Field of Search ..... 51/417, 418, 439, 410, 51/426, 432–435, 318–319; 241/40, 275; 134/64 R, 64 P, 122 R, 122 P; 239/288, 288.3, 288.5, 222

[56] References Cited

U.S. PATENT DOCUMENTS

| | | | |
|---|---|---|---|
| 894,272 | 7/1908 | Jorn | 51/410 |
| 1,850,545 | 3/1932 | Gredell | 51/435 |
| 1,940,539 | 12/1933 | Fritsche | 51/8 |
| 2,195,810 | 4/1940 | Bower | 51/14 |
| 2,524,097 | 10/1950 | Barr et al. | 51/8 |
| 2,532,136 | 11/1950 | Zahn | 51/417 |
| 2,590,576 | 3/1952 | Rosenberger et al. | 51/434 |
| 2,616,222 | 11/1952 | Russell | 51/8 |
| 2,789,804 | 4/1957 | Toulmin, Jr. | 51/434 |
| 2,897,692 | 8/1959 | Beckner et al. | 51/439 |
| 3,138,900 | 6/1964 | Greenberg et al. | 51/417 |
| 3,283,450 | 11/1966 | Greenberg et al. | 51/417 |
| 3,290,827 | 12/1966 | Bowling et al. | 51/9 |
| 3,561,163 | 2/1971 | Arnold | 51/8 |
| 3,731,432 | 5/1973 | Carpenter, Jr. | 51/424 |
| 3,851,421 | 12/1974 | Stroszynski | 51/11 |
| 3,936,979 | 2/1976 | Fuerst | 51/434 |
| 4,270,317 | 6/1981 | Kurie | 51/426 |
| 4,272,612 | 6/1981 | Oliver | 51/439 |

FOREIGN PATENT DOCUMENTS

| | | | |
|---|---|---|---|
| 2374141 | 8/1978 | France | 51/417 |
| 0374565 | 2/1964 | Switzerland | 51/426 |

*Primary Examiner*—Frederick R. Schmidt
*Assistant Examiner*—Robert A. Rose
*Attorney, Agent, or Firm*—Porter & Bremer Co.

[57] ABSTRACT

Apparatus for etching a metal surface utilizes a specially shrouded centrifugal throwing wheel to effect a uniform, non-pulsating application of very fine, lightweight, impact blasting media. The resulting etched finish is of a fine-grained quality suitable for use in lithography. A replaceable, wear-resistant liner is provided within the shroud.

21 Claims, 5 Drawing Figures

IMPACT BLASTING SYSTEM FOR ETCHING METAL SURFACES

CROSS REFERENCE TO RELATED APPLICATION

This is a continuation of application Ser. No. 354,916, filed Mar. 4, 1982, now abandoned.

BACKGROUND OF THE INVENTION

The present invention relates generally to apparatus and methods for impact blasting lithographic sheet material and the like with a very fine, lightweight blasting media to provide a fine-grained, uniformly etched finish.

Metal sheets used in lithographic printing processes require finely textured, uniformly etched surfaces. A preferred material for use in lithography is aluminum and alloys thereof, but other materials may also be used. Surface etching of lithographic sheet material is normally conducted using chemical etching techniques. Chemical etching is effected by applying one or more chemicals to the surface to be etched. A chemical reaction results which causes portions of the exposed metal surface to be eaten away, thereby creating a uniform array of fine surface indentations which give the resulting product a fine-grained, satin-like finish.

While chemicl etching techniques are capable of providing suitably uniform finishes, these techniques are expensive to perform. Moreover, the resulting spent chemicals include hazardous substances which present environmental disposal problems. In view of these drawbacks, industry has long sought a suitable, less expensive, non-polluting method of uniformly etching the surfaces of metal sheets for use in lithography.

The type of etched finish required for use in lithography is quite different from the type of surface treatment normally obtained using impact blasting techniques. If an etched finish is to be acceptable for lithographic purposes, it must be quite smooth, typically about as smooth as the types of surfaces which result from some honing, cold rolling, drawing or grinding operations. In many instances, the surface must be as smooth as that which is achieved with drilling or milling operations. Moreover, the etched surface profile must be held to what is known in the art as a specified "AA" etch number, with a tolerance of only plus or minus 3AA over the entire etched surface. Typically, the specified "AA" number is within the range of about 17AA to about 40AA.

Impact blasting techniques previously have been found to be incapable of providing the type of etched surface required for lithographic purposes. The etching surface consistency required for lithographic sheets is far more stringent than that obtainable through the use of conventionl impact blasting techniques.

SUMMARY OF THE INVENTION

The present invention overcomes the foregoing and other drawbacks of prior proposals by providing apparatus and methods for impact blasting a metal surface to consistently provide a fine-grained, uniformly etched finish which is well suited for use in lithographic operations and the like.

In accordance with the preferred practice of the present invention, a conventionl centrifugal throwing wheel is provided with a specially configured shroud for ducting impact blasting media from the throwing wheel toward a sheet of metal which is moving along a feed path. A very fine, commercially available, mineral sand is used as an impact blasting media. The specially shrouded throwing wheel is capable of providing an extraordinarily uniformly etched surface finish of approximately 40AA on a sheet or web of metal moving along a feed path at the relatively high speed of about 70 feet per minute.

In working with extremely fine, extremely lightweight blasting media, as is required to provide a finely-grained etched surface of the type needed in lithography, a problem of non-uniformity in delivery of the blasting media has been encountered. This problem previously has not been detected in conventional blasting operations where heavier shot or grit is used. Where very fine-grained, lightweight blasting media is used, non-uniformities, having the appearance of elongate, shadow-like streaks, have been found to be present in the resulting etched surface. While these shadowy non-uniformities may be relatively inconspicuous to the human eye, they render an etched surface totally unsuitable for use in lithography. Streaks extend across the etched surface in directions extending substantially perpendicular to the direction of the feed path along which the workpiece moves relative to the throwing wheel.

Through careful experimentation, it has been found that a properly configured blasting wheel shroud, positioned at an appropriate distance from the workpiece, will overcome the natural tendency of the throwing wheel to deliver fine-grained, lightweight blasting media in a pulsating, nonuniform pattern. It is believed that the type of pulsating application pattern which is encountered where a conventional centrifugal throwing wheel is used to apply very lightweight, fine-grained blasting media results from what is akin to the "beat frequency" phenomena encountered in centrifugal fans. Inasmuch as a centrifugal throwing wheel can be thought of as constituting a modified form of centrifugal fan, the general type of beat frequency phenomena encountered in centrifugal fans undoubtedly has a counterpart type of phenomena in centrifugal throwing wheels.

In a centrifugal fan, the beat frequency is the frequency at which bursts or pulses of air are discharged from the fan. It is known that a beat frequency phenomena can result where a relatively large duct section is connected to a centrifugal fan by means of a relatively small duct section. It is believed that, with a centrifugal throwing wheel, the wheel housing is substantially equivalent to a small duct, and the chamber into which impact blasting media discharges is substantially equivalent to a large duct. If this theory is correct, it offers an explanation as to why a non-uniform, pulsating discharge occurs when a centrifugal throwing wheel is used to propel very fine-grained, lightweight blasting media, for a flow of air containing such media will undoubtedly behave very much like a flow of air which contains no particles at all.

Stated in another way, this theory, if correct, offers an explanation as to why workpiece surfaces etched with fine-grained, lightweight media discharging from a conventional centrifugal throwing wheel are found to have streaks. The streaks result from something akin to a beat frequency phenomena in that the flow of media is a pulsating type of flow which cannot achieve uniform application. Unfortunately, however, this theoretical explanation does nothing to suggest a solution to the problem of streaking.

While conventional teachings dealing with the art of centrifugal fans suggest that best frequency pulsations of a fan can be relieved by dampering the fan's inlet, efforts to damper the inlet of a centrifugal throwing wheel were found to provide no improvement. Similarly, while centrifugal fan technology suggests that dampering the outlet of a fan may help to reduce beat frequency problems, fans are not used to provide a uniform application pattern of impact blasting media, and the information to be gleaned from centrifugal fan technology was not found to suggest a suitable solution.

The solution presented by the present invention utilizes a specially configured shroud which connects with the housing of a conventional centrifugal throwing wheel. The shroud alters the flow of impact blasting media which passes through the shroud to eliminate the pulsations which characteristically occur when a conventional centrifugal throwing wheel is used to apply very fine lightweight blasting media. A shroud embodying features of the present invention utilizes opposed side walls which are inclined relative to each other to effect a slight funneling or narrowing of the width of the path of discharge of media, whereby the flow of media is caused to interact with itself in such a manner that it dampens and eliminates flow pulsations.

A further aspect of the invention lies in a determination that the outlet of the shroud must be positioned at an adequate distance from the workpiece surface being etched to prevent the occurrence of an air-spring action which can feed back into the shroud and prevent its proper operation. Different minimum shroud-to-workpiece distances are required with different throwing wheel parameters. By way of example, a 14 inch diameter throwing wheel operating at 1250 RPM and having a shroud outlet positioned at about 16 inches from a workpiece surface will produce a flawlessly etched surface. However, a 19½ inch throwing wheel operating at 900 RPM will give about the same blasting media velocity as the above-described situation involving a 14 inch wheel, but the 19½ inch wheel will pump nearly twice as much air in the process; accordingly, the shroud outlet used with the 19½ inch wheel must be positioned farther from the workpiece to prevent air from becoming "trapped" between the shroud and the workpiece thereby creating an air spring action that feeds back into the shroud and prevents the shroud from properly performing its pulsation-dampening function.

Inasmuch as it is not fully understood precisely why the present invention functions as it does to overcome the problem of non-uniform application of lightweight impact blasting media issuing from a centrifugal throwing wheel, the apparatus and methods of the invention are described and claimed in terms of such parameters as have been found by tests to contribute to and provide features of an operable system.

BRIEF DESCRIPTION OF THE DRAWINGS

The foregoing and other features and advantages of the invention will be better understood by referring to the following description of the preferred embodiment and the claims, taken in conjunction with the drawings wherein:

DESCRIPTION OF THE PREFERRED EMBODIMENT

Figure 1:
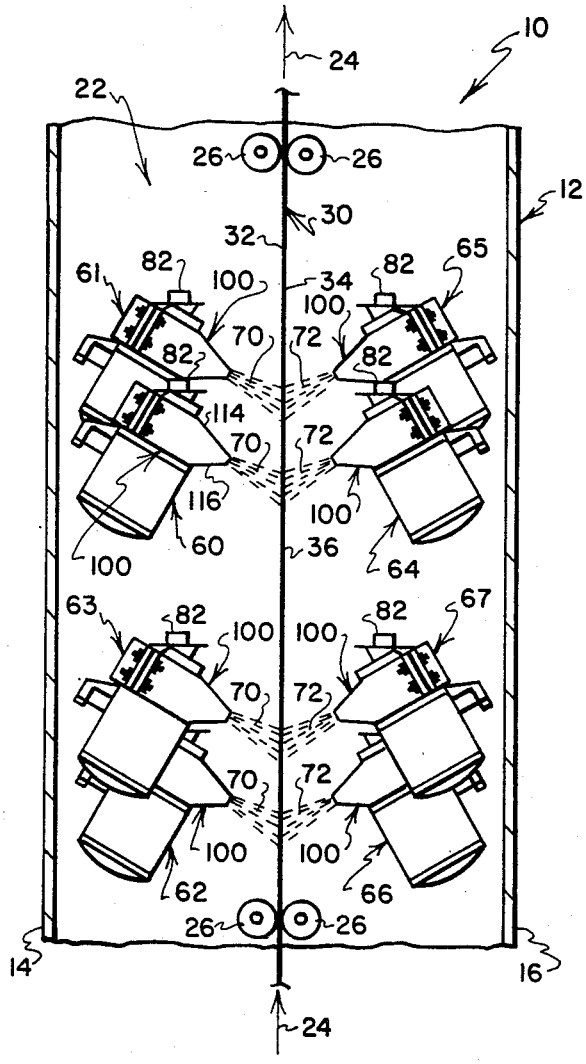
FIG. 1 is a schematic front elevational view of an impact blasting apparatus embodying features of the present invention, with portions of the apparatus broken away.
Figure 2:
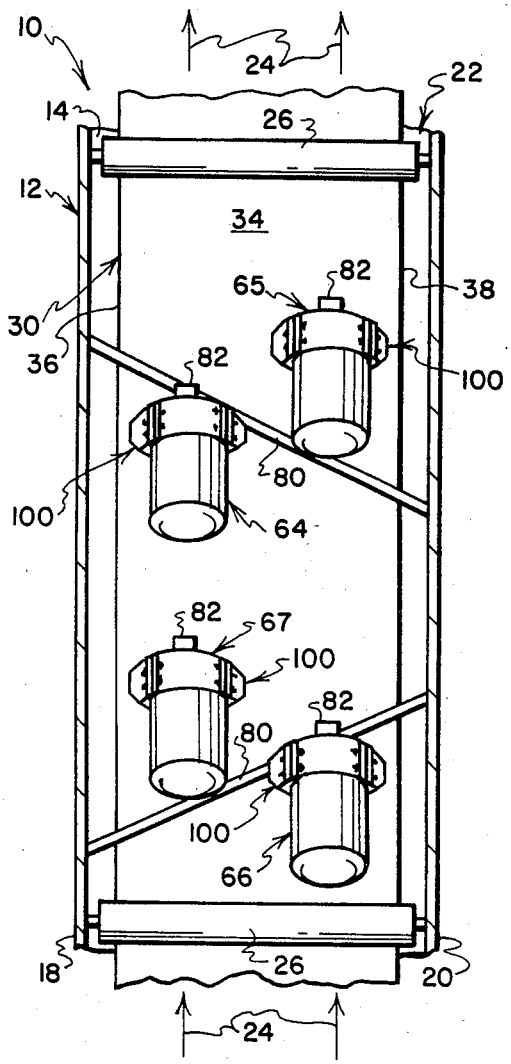
FIG. 2 is a schematic side elevational view thereof.

Referring to FIGS. 1 and 2, an impact blasting apparatus for etching opposed side surfaces of a traveling web of metal is indicated generally by the numeral 10. The system 10 includes an enclosure 12 having four upstanding walls 14, 16, 18, 20 which define a treating chamber 22. The treating chamber 22 surrounds portions of a vertically-oriented feed path indicated by arrows 24. A web or elongate sheet of metal 30 is fed upwardly along the feed path 24. Sets of rolls 26 or other suitable positioning means are provided to position the web of metal 30 for travel along the feed path 24. The metal 30 typically comprises aluminum, or an alloy thereof, or some other metal which, when properly etched, may be used in lithography. The web of metal 30 is typically about 50 inches in width.

The feed path 24 extends substantially centrally through the chamber 22 defined by the enclosure 12. The web of metal 30 has opposed side surfaces 32, 34 and opposed edge surfaces 36, 38. The opposed side surfaces 32, 34 of the web of metal 30 parallel the upstanding walls 14, 16 of the enclosure 12. The opposed edge surfaces 36, 38 of the web of metal 30 parallel the upstanding walls 18, 20 of the enclosure 12.

Eight centrifugal throwing wheel assemblies 60, 61, 62, 63, 64, 65, 66, 67 are housed within the enclosure 12. The throwing wheel assemblies 60, 61, 62, 63 are located on the left side of the web of metal 30, as viewed in FIG. 1, for directing impact blasting media along paths indicated by the numerals 70 toward the metal side surface 32. Similarly, the throwing wheel assemblies 64, 65, 66, 67 are located on the right side of the web of metal 30, as viewed in FIG. 1, for directing impact blasting media along paths indicated by the numerals 72 toward the metal side surface 34.

The throwing wheel assemblies 60–67 are arranged in a staggered array within the enclosure 12 so that the patterns of impact blasting media 70, 72 which discharge from the assemblies 60–67 onto the web of metal 30 cooperate to thoroughly expose the opposed surfaces 32, 34 of the sheet 30 to an etching action. The assemblies 60–67 are paired such that: (1) the assemblies 60, 61 cooperate to cover the full width of the sheet surface 32 with one application of impact blasting media 70; (2) the assemblies 62, 63 cooperate to cover the full width of the sheet surface 32 with another application of impact blasting media 70; (3) the assemblies 64, 65 cooperate to cover the full width of the sheet surface 34 with one application of impact blasting media 72; and, (4) the assemblies 66, 67 cooperate to cover the full width of the sheet surface 34 with another application of impact blasting media 72.

The staggered array of the assemblies 60–67 is provided so that the pattern of impact blasting media discharging from any one of the assemblies 60–67 will not interfere with the pattern of impact blasting media discharging from others of the assemblies 60–67. Moreover, as is shown somewhat schematically in FIG. 2, divider plates 80 are provided between such ones of the assemblies 60–67 as are positioned relatively closely to each other. The plates 80 further assure that impact blasting media issuing from any one of the assemblies 60–67 does not interfere with media issuing from another of the assemblies 60–67.

Impact blasting media is supplied to the assemblies 60–67 through a suitable system of conduits (not shown) which connect with inlet structures 82 provided on each of the assemblies 60–67. Once the blasting media 70, 72 has impacted with the web of metal 30, the media is collected within the enclosure 12 using conventional apparatus (not shown) so that the media can be recycled and reused. U.S. Pat. No. 3,731,432 issued May 8, 1973 to James H. Carpenter, Jr., et al, describes one typically suitable system for delivering and collecting impact blasting media. The disclosure of this patent is incorporated herein by reference.

The assemblies 60–67 are supported within the enclosure 12 by suitable mounts (not shown) which position and orient the assemblies 60–67 to discharge impact blasting media 70, 72 as shown and described. The assemblies 60–67 include conventional centrifugal throwing wheel units of the general type described in U.S. Pat. No. 3,290,827 issued Dec. 18, 1966 to J. E. Bowling et al, the disclosure of which is incorporated herein by reference. The assemblies 60–67 additionally include shroud structures 100 which, in accordance with features of the present invention, serve to influence the flow of impact blasting media which issues from their associated throwing wheels to dampen pulsations and thereby enable the assemblies 60–67 to effect uniform applications of impact blasting media on opposed side surfaces 32, 34 of the web of metal 30.

Figure 3:
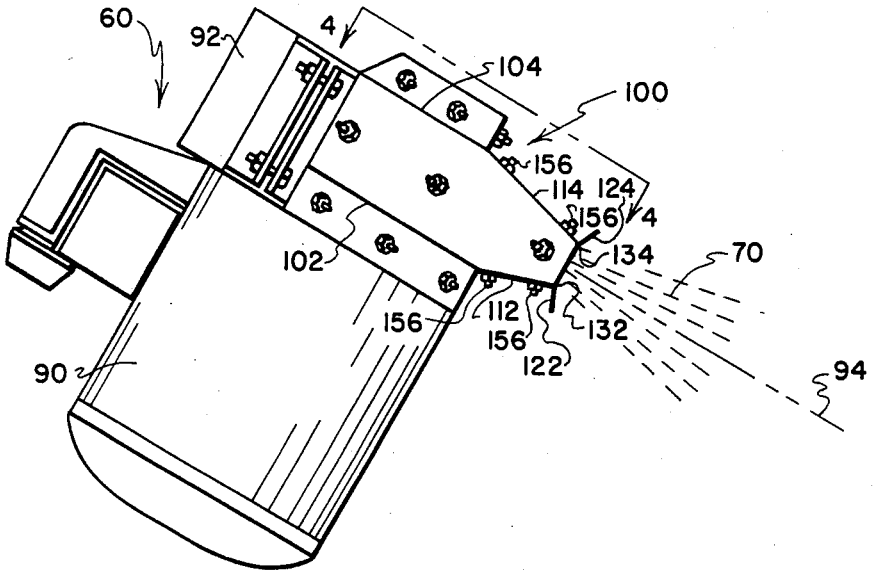
FIG. 3 is a front elevational view, on an enlarged scale, of one of the shrouded centrifugal throwing wheel assemblies which is utilized in the apparatus of FIGS. 1 and 2.

Referring to FIG. 3, the throwing wheel assembly 60 and its shroud structure 100 are depicted in greater detail. The assembly 60 has a motor enclosure 90 and a wheel housing structure 92. The shroud structure 100 cooperates with the housing structure 92 to enclose a rotary blast wheel (not shown), which tends to project impact blasting media along a discharge path which centers about a plane indicated in FIGS. 3 and 5 by the numeral 94. The shroud structure 100 is configured, in accordance with features of the present invention, to funnel the flow of impact blasting media 70 toward the web of metal 30 in such a manner as will effect a uniform, non-pulsating application of the media 70 to the surface 32 of the web of metal 30.

Figure 4:
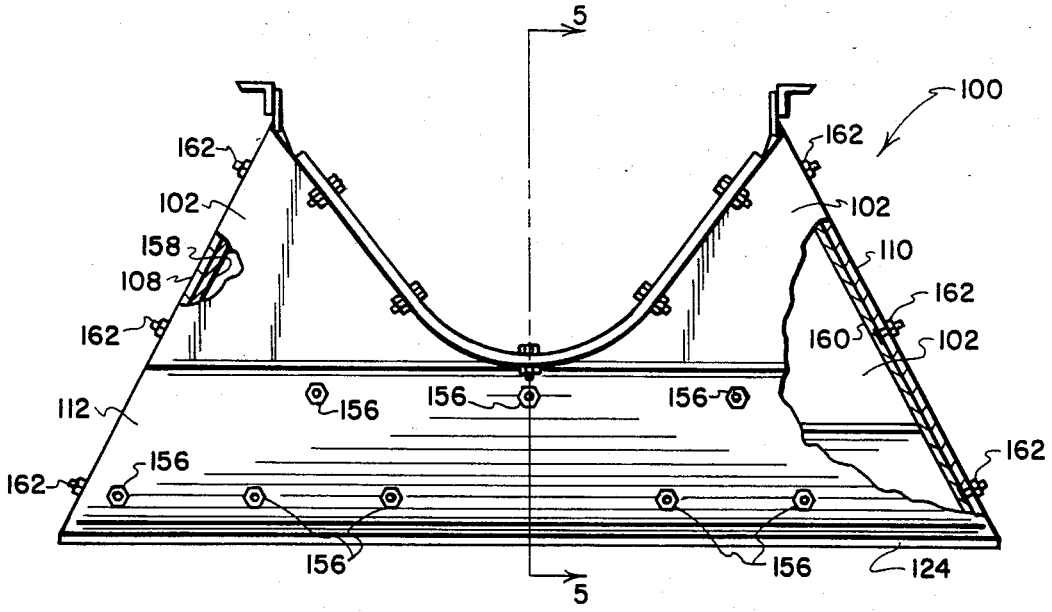
FIG. 4 is a view, on an enlarged scale, of a shroud structure used on the throwing wheel assembly of FIG. 3, with portions of the shroud broken away, as seen from a plane indicated by a line 4—4 in FIG. 3; and, FIG. 5 is a sectional view, on an enlarged scale, as seen generally from a plane indicated by a line 5—5 in FIG. 4.
Figure 5:
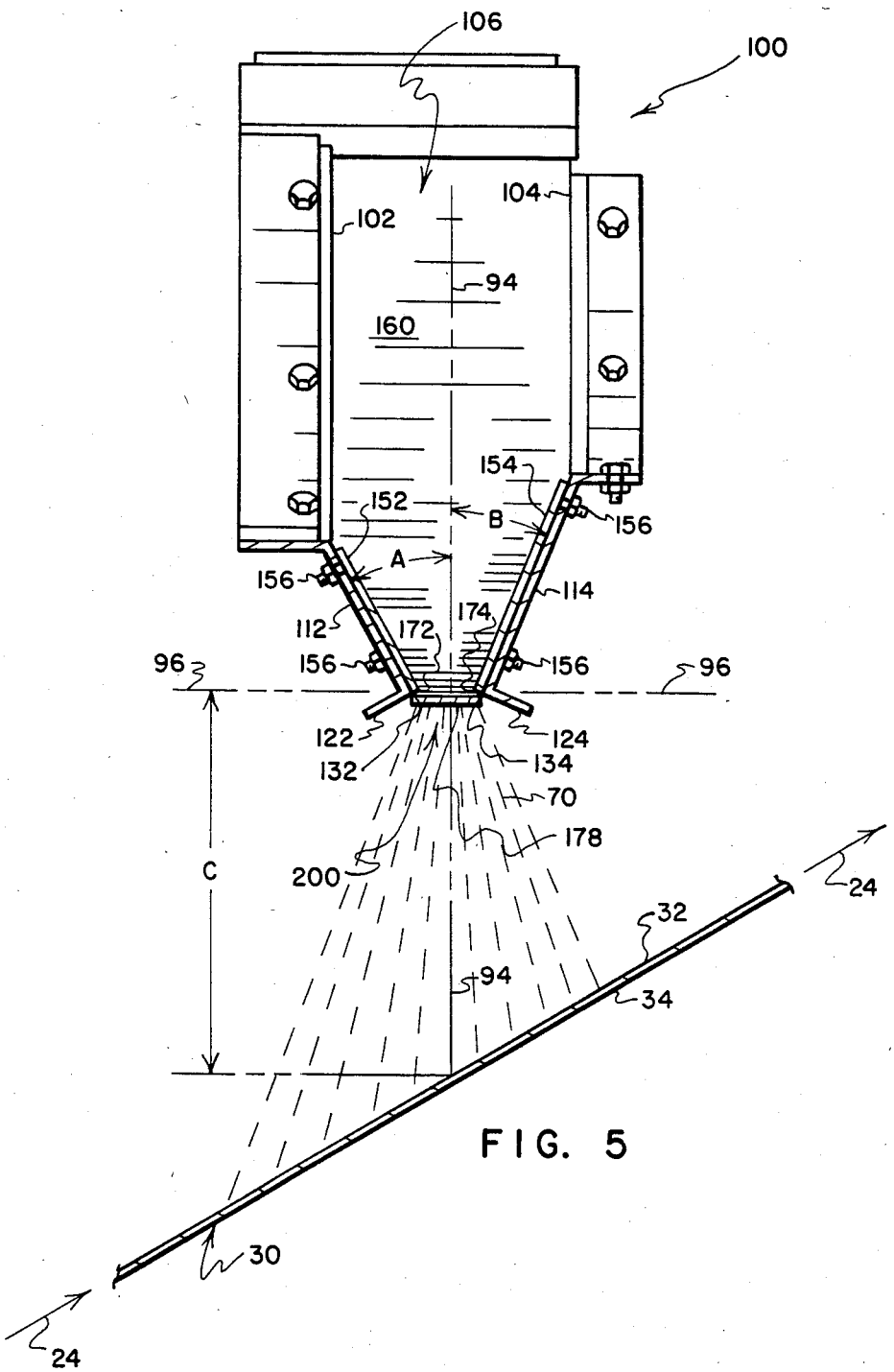

Referring to FIGS. 4 and 5, the shroud structure 100 includes a pair of spaced, parallel-extending side wall plates 102, 104 which define opposite side walls of a chamber 106 which houses a portion of a vaned centrifugal throwing wheel of conventional configuration (not shown). Depending portions 112, 114 of the side wall plates 102, 104 are inclined inwardly toward the plane 94. The plate portion 112 is inclined relative to the plane 94 at an angle "A" of about 22 degrees. The plate portion 114 is inclined relative to the plane 94 at an angle "B" of about 30 degrees. Outwardly turned flanges 122, 124 are formed at the lower ends of the plate portions 112, 114. The flanges 122, 124 have inner corners 132, 134 (1) which extend parallel to each other, (2) which parallel the plane 94, and (3) which are located at equal distance on opposite sides of the plane 94.

The shroud structure 100 additionally includes a pair of end wall plates 108, 110 which define opposite end portions of the chamber 106. The end wall plates 108, 110 extend between and join opposed end portions of the side wall plates 102, 104, and cooperate with the side wall plates 102, 104 to define a closed-wall conduit for directing impact blasting media toward the web of metal 30.

A replaceable wear-resistant liner is preferably provided on the inner surfaces of the plate portions and on the inner surfaces of the end wall plates 108, 110. Referring to FIGS. 4 and 5, the liner includes wear plates 152, 154 which are secured by threaded fasteners 156 to the wall portions 112, 114, and wear plates 158, 160 which are secured by threaded fasteners 162 to the end walls 108, 110.

The wear plates 152, 154 have edges 172, 174 which define opposed sides of a discharge opening, indicated generally by the numeral 200. The discharge opening 200 extends substantially within a plane indicated in FIG. 5 by the numeral 96. The plane 96 is perpendicular to the plane 94.

The wear plates 158, 160 have edges 178, one of which is shown in FIG. 5, which define opposite ends of the discharge opening 200. In the event no wear plates are used to line the inner surfaces of walls and wall portions 108, 110, 112, 114, these walls and wall portions will then define the sides and ends of the discharge opening 200.

A feature of the invention lies in the discovery that there is a minimum distance between the discharge opening 200 and the workpiece surface 32 which must be maintained if the shroud structure 100 is to function properly. The best way to determine this minimum distance for each set of impact system parameters (i.e., throwing wheel size, throwing wheel velocity, angle of the throwing wheel plane 94 relative to the plane of the workpiece surface 32, etc.) is by experimentation. If the discharge opening 200 is located too close to the workpiece surface 32, air apparently becomes "trapped" between the workpiece surface 32 and the shroud structure 100, and can feedback into the shroud structure 100 inhibiting its normal operation in dampening media flow pulsations. When the discharge opening 200 is located too closely to the moving workpiece surface 32 shadowy streaks or other non-uniformities will become apparent in the resulting etched surface. It is believed that the maximum distance which can be utilized between the opening 200 and the surface 32 is limited not by a problem of non-uniform media application, but rather by such problems as a failure of impact media momentum to properly carry the media into contact with the workpiece surface 32. In short, so long as the required minimum distance is observed, the opening 200 may be positioned at any reasonable distance from the workpiece surface 32.

In operation, a very fine-grained, commerically available, impact blasting media is fed in a conventional manner to the assemblies 60–67, and each of the assemblies 60–67 is operated in the conventional manner to discharge the media along a path of discharge which centers about such a plane as the plane 94. The shroud structures 100 duct the media toward the moving web of metal 30, and narrow the width of the flow of the media as the media passes between the relatively inclined plate portions 112, 114. During this funneling process, the flowing media interacts with itself to dampen such flow pulsations as tend to occur where a conventional centrifugal throwing wheel is used to propel very fine, very lightweight media. The dampening action which takes place assures that a uniform, non-pulsating flow of media is applied to the surfaces of the web of metal 30, whereby an exceptionally uniform, fine-grained etching operation is performed on these surfaces.

In one test, the throwing wheel assemblies 60–67 each employed a conventional 14 inch diameter throwing wheel rotating at about a 1600 RPM and throwing approximately 31,000 pounds per hour of media having a bulk density of about 184 pounds per cubic foot. Wheel rotation speeds within the range of 900 RPM to 2000 RPM were also tried and found to be operable. The web of metal 30 to be etched was 50 inches wide and moved along the feed path 24 at a speed of 70 linear feet per minute. The media was zircon sand comprised by weight of 17 percent at 100 mesh (0.0059 inch squares), 59 percent at 140 mesh (0.0041 inch squares), 21 percent at 200 mesh (0.0029 inch squares), and a 3 percent remainder of smaller particles. The assemblies 60–67 were inclined with respect to the feed path 24 such that their respective planes 94 intersected the feed path 24 at angles of about 30 degrees; however, it was found that angles within the range of 15° to 31½° worked equally well. Angles outside this range were not tested. The distance between the discharge openings 200 and the workpiece surfaces being etched, as indicated in FIG. 5 by the dimension "C", was about 16 inches, but was found to work equally well when increased to about 22 inches. Less than about a 16 inch distance brought an onset of streaking. Utilizing these parameters, a uniformly etched surface finish of approximately 40AA was obtained satisfactorily and consistently. No problems with such non-uniformities as streaking were observed.

Although the invention has been described in its preferred form with a certain degree of particularity, it will be understood that the present disclosure of the preferred form has been made only by way of example and that numerous changes in the details of construction and the combination and arrangement of parts may be resorted to without departing from the true spirit and scope of the invention as hereinafter claimed.

What is claimed is:

1. Apparatus for etching the surface of a metal workpiece for lithographic purposes, comprising:

a treating chamber;

positioning means for positioning a workpiece within the treating chamber;

a centrifugal throwing wheel for receiving and projecting fine-grained, lightweight impact blasting media along a path of discharge onto the surface of a workpiece positioned within the treating chamber, the path of discharge being elongate in cross-section and extending along a first plane; and shroud means connected to the centrifugal throwing wheel and extending about the discharge path for ducting the impact blasting media from the centrifugal throwing wheel toward the workpiece, the shroud means including:

first and second side walls extending in overlying but non-parallel relationship along opposite sides of the discharge path;

first and second end walls interconnecting the first and second side walls and cooperating therewith to define a closed-wall duct which is open at one end to receive the impact blasting media from the centrifugal throwing wheel, and which defines an elongate discharge opening at the other end thereof for discharging the impact blasting media toward the workpiece;

the first and second side walls being inclined relative to each other in a converging relationship for funneling and dampening the flow of blasting media as it moves along the discharge path between the first and second side walls to narrow the width of flow of the media in one dimension as the media travels through the duct;

the first and second side walls having opposed portions which are disposed on opposite sides of the first plane and which extend in spaced, parallel relationship to each other and to the first plane so as to define opposite sides of the discharge opening, the opposite sides of the discharge opening extending in a second plane substantially perpendicular to the first plane; and the discharge opening being spaced from the surface of the workpiece a distance close enough so that the surface is etched, but great enough that non-uniform etching is avoided.

2. The apparatus of claim 1, wherein the angle between the first plane and the surface of the workpiece is within the range of 15 degrees to 31½ degrees, measured from a perpendicular intersection of the first plane and the surface.

3. The apparatus of claim 1, wherein the centrifugal throwing wheel is 14 inches in diameter and the discharge opening is spaced within the range of 16 to 22 inches from the surface of the workpiece.

4. The apparatus of claim 1, wherein the opposite sides of the discharge opening are positioned at substantially equal distances from the first plane.

5. The apparatus of claim 1, wherein:

the centrifugal throwing wheel is housed within the treating chamber;

the positioning means supports the workpiece for movement through the treating chamber;

the workpiece is in the form of an elongate sheet having opposed side surfaces; and, the centrifugal throwing wheel is oriented to project blasting media toward at least a portion of one of the opposed sides of the sheet.

6. The apparatus of claim 5, further including a second centrifugal throwing wheel and a second shroud means substantially identical to the first centrifugal throwing wheel and the first shroud means, respectively, the second centrifugal throwing wheel and the second shroud means being housed within the treating chamber.

7. The apparatus of claim 1, wherein said first and second side wall means have an inner surface having a removable wear liner means protectively covering at least a portion thereof.

8. The apparatus of claim 1 wherein said first and second end wall means have an inner surface having a removable wear liner means protectively covering at least a portion thereof.

9. The apparatus of claim 1 wherein:

the throwing wheel rotates about an axis of rotation; and the first plane is substantially perpendicular to the axis of rotation.

10. The apparatus of claim 1 wherein one side wall is inclined relative to the first plane within the range of about 22 to about 30 degrees.

11. The apparatus of claim 1 wherein the first side wall is inclined at a first angle relative to the first plane, and the second side wall is inclined relative to the first plane at a second angle which is unequal to said first angle.

12. The apparatus of claim 1 wherein the first angle is approximately 22 degrees, and the second angle is approximately 30 degrees.

13. The apparatus of claim 6 further including a barrier means interposed between the two throwing wheels for preventing impact blasting media projected from one of the throwing wheels from mixing with the impact blast media projected from the other throwing wheel.

14. The apparatus of claim 6 wherein the throwing wheels are positioned to project impact blasting media toward opposite sides of said workpiece.

15. Shroud means for use with a centrifugal throwing wheel assembly for directing impact blasting media being discharged therefrom, the shroud means comprising:

(a) first and second non-parallel side walls disposed on opposite sides of an elongate discharge path extending along a first plane;

(b) first and second end walls interconnecting the first and second side walls and cooperating therewith to define a duct which is open at one end to receive impact blasting media from the centrifugal throwing wheel, and which defines an elongate discharge opening at the other end thereof for discharging impact blasting media toward a workpiece;

(c) the first and second side walls being inclined relative to each other in a converging relationship to impart a non-pulsating effect to the flow of impact blasting media as it travels between the first and second side walls and to narrow the flow as the media travels through the duct; and (d) the first and second side walls having opposed portions which are disposed on opposite sides of the first plane and which extend in spaced parallel relationship to each other and to the first plane so as to define opposite sides of the discharge opening, the opposite sides of the discharge opening extending in a second plane substantially perpendicular to the first plane.

16. The shroud means of claim 15 wherein the first and second side walls have an inner surface having a removable wear liner means protectively covering at least a portion thereof.

17. The shroud means of claim 15 wherein the first and second end walls have an inner surface having a removable wear liner means protectively covering at least a portion thereof.

18. The shroud means of claim 15, wherein one side wall is inclined relative to the first plane within the range of about 22 to about 30 degrees.

19. The shroud means of claim 15, wherein the first side wall is inclined at a first angle relative to the first plane, and the second side wall is inclined relative to the first plane at a second angle which is unequal to said first angle.

20. The shroud means of claim 19, wherein the first angle is approximately 22 degrees, and the second angle is approximately 30 degrees.

21. The shroud means of claim 15, wherein the opposite sides of the discharge opening are positioned at substantially equal distances from the first plane.

* * * * *